United States Patent [19]

Johnston

[11] Patent Number: 4,649,889

[45] Date of Patent: Mar. 17, 1987

[54] MOLDED BOW LIMB

[75] Inventor: Richard Johnston, Tucson, Ariz.

[73] Assignee: Precision Shooting Equipment Company, Tucson, Ariz.

[21] Appl. No.: 788,127

[22] Filed: Oct. 16, 1985

[51] Int. Cl.[4] ..... F41B 5/00

[52] U.S. Cl. ..... 124/23 R; 273/DIG. 7; 124/DIG. 1; 156/176

[58] Field of Search ..... 124/24 R, 23 R, DIG. 1; 273/DIG. 7, DIG. 23

[56] References Cited

U.S. PATENT DOCUMENTS 2,894,503 7/1959 Pierson et al. ..... 124/23 R 3,670,040 4/1972 Shobert ..... 124/23 R

*Primary Examiner*—Richard C. Pinkham

*Assistant Examiner*—Gary Jackson

*Attorney, Agent, or Firm*—Jack E. Dominik

[57] ABSTRACT

A bow limb which is totally molded essentially filled with unbroken longitudinal strands of fiberglass oriented in the central configuration in parallel strands, but as approaching the exterior of the bow, the strands conform to the exterior configuration of the limb. The bow limb is also characterized by a substantially constant cross-section even though width and thickness may vary longitudinally. This maintains a constant ratio of resin to fiberglass which is important to insure uniform strength characteristics. If the concentration of resin to fiberglass becomes too great, a brittle or weak point which invites breakage can occur. If the fiberglass to resin ratio is too great, inadequate bonding can result in bending failure.

4 Claims, 13 Drawing Figures

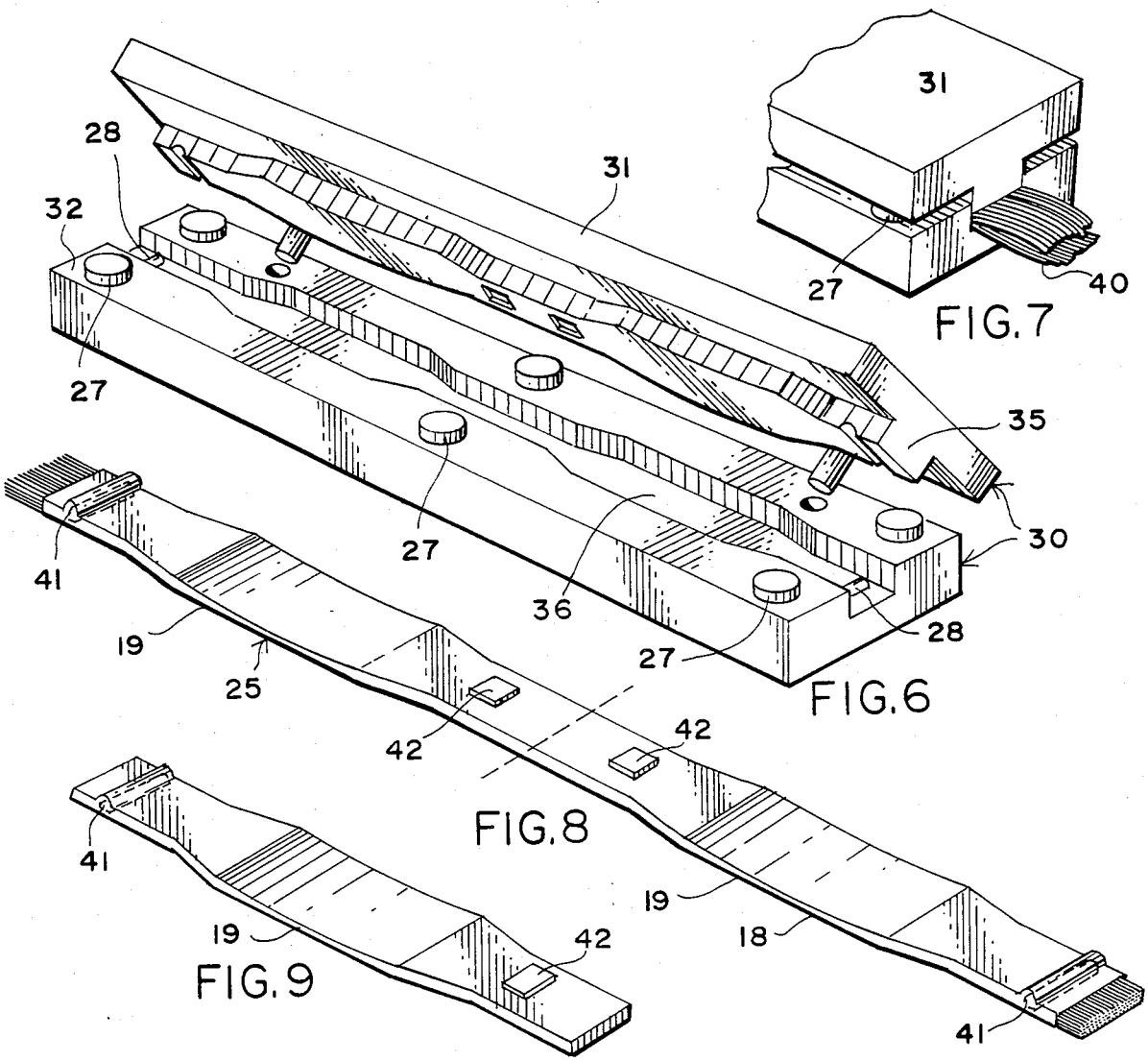
FIG. 6
FIG. 7
FIG. 8
FIG. 9
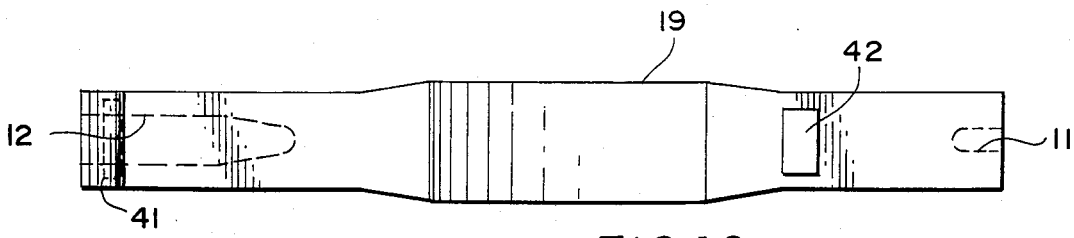
FIG. 10
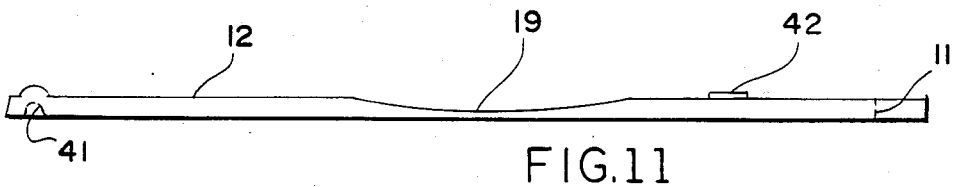
FIG. 11

MOLDED BOW LIMB

FIELD OF THE INVENTION

The present invention is directed to the archery industry, and more specifically an archery bow comprising a pair of limbs, and a handgrip portion having means for mounting the limbs. More specifically the invention is directed to a bow limb of which the outside profile is totally molded and not machined which is primarily a reinforced plastic unitary construction.

SUMMARY OF THE PRIOR ART

Heretofore bow limbs have basically been formed from a single block of reinforced fiberglass material, the same being bonded by a polyester or epoxy resin. The blocks contain longitudinal strands of fiberglass oriented in a generally parallel fashion. The machining steps employed are to form the limb both as to its width and height, each of which varies, and to place the appropriate butt slot and fork slot to accommodate the pivot unit and axle and wheel assembly respectively In the process of machining, considerable time is consumed, and accuracies and repeatability are not guaranteed. Furthermore, in the machining process of the back and/or face of the limb the ends of the fiberglass strands are severed when the solid block is machined to a thinner configuration exposing the working part of the limb to exposed fiber ends which could develop as splinters.

SUMMARY OF THE INVENTION

The present invention is directed to a bow limb in which the outside profile is totally molded essentially filled with unbroken longitudinal strands of fiberglass oriented in the central configuration in parallel strands, but as approaching the exterior of the bow, the strands conform to the exterior configuration of the limb. The bow limb is also characterized by a substantially constant cross-section even though width and thickness may vary longitudinally. This maintains a constant ratio of resin to fiberglass which is important to insure uniform strength characteristics. If the concentration of resin to fiberglass becomes too great, a brittle or weak point which invites breakage can occur. If the fiberglass to resin ratio is too great, inadequate bonding can result in bending failure. Impregnated fiberglass strands are wrapped around a frame to create a fiberglass and resin blank or package. The wet blank or package is then placed in the mold to be shaped and cured. The package has a calculated predetermined number of fiberglass strands, and also a calculated predetermined volume and weight of plastic resin. The mold, has two parts, a male and female. The volume of the mold may be simultaneously thinned and widened in forming the mold in such a manner that the cross-section is constant at any given point. The thickness of the limb can be varried in accordance with the depth of penetration of the male member of the mold into the female. A tail of the excess fiberglass and resin extends from both ends of the mold, and after the formed unit or paddle is first cured and then removed from the mold; these are removed with a saw cut. The paddle is removed from the mold as soon as cured to the handling point, and then finish cured in an oven. When totally cured the paddle is severed into two limbs.

In view of the foregoing it is a principal object of the present invention to provide a pair of bow limbs with unbroken longitudinal strands of fiberglass and a smooth sealed exterior.

Yet another object of the present invention is to provide a bow limb with unbroken longitudinal strands of fiberglass and in which the ratio of resin to fiberglass throughout the length of the bow limb is retained relatively constant.

Still another accomplishment of this invention is to eliminate machining required to precisely mount an axle holder for the eccentric pulley. Traditionally either a cross drilled hole is required, or vertically drilled holes are formed in order to properly locate and glue on an external unit with a pre-drilled axle hole. By the use of a dished area in the male mold and an opposing protrusion in the female mold permitting the strands to flow unrestricted toward the limb and a ready made axle cavity is preformed.

Also, the invention permits preselecting the area of flex on the limb by varying the thickness of the limb while maintaining a constant cross-section. A related feature permits varying the thickness of the limb and hence its weight by varying the depth of penetration of the mold male member into the female member with a varying size resin blank or package.

Yet another object of the present invention is to provide a bow limb in which a high degree of repeatability and uniformity of construction results from the method of forming.

BRIEF DESCRIPTION OF THE DRAWINGS

Further objects and advantages of the present invention will become apparent as the following description of an illustrative embodiment takes place, taken in conjunction with the accompanying drawing, in which:

FIG. 6 is a perspective view of the mold assembly;

FIG. 7 shows in part the bow limb mold while a paddle is curing, and illustrating the existence of a tail which extends from the mold assembly thereby insuring a slight overfill of the mold cavities to the end that voids in the bow limb mold are eliminated;

FIG. 8 is a view of the molded paddle showing the tail prior to being severed or being separated with a separated limb shown to the right;

FIG. 9 is a bottom view of the molded bow limb before maching bolt and wheel slots;

FIG. 10 is a front elevation of the molded bow limb;

FIG. 11 is a side view of the limb shown in FIG. 10;

DESCRIPTION OF A PREFERRED EMBODIMENT

Figure 1:
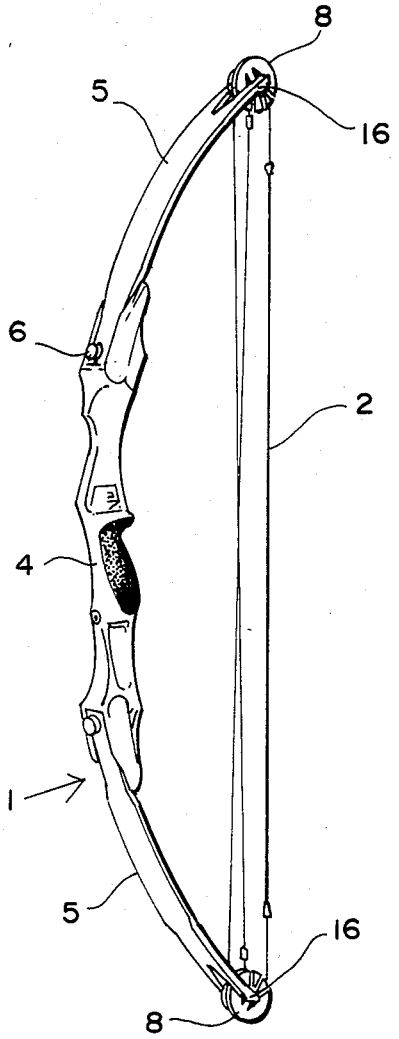
FIG. 1 is a perspective view of an illustrative archery bow showing its components, and specifically the bow limbs.
Figure 3:
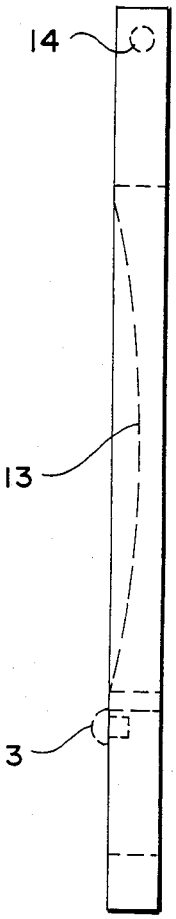
FIG. 3 PRIOR ART
FIG. 3 is a front elevation of the prior art bow limb shown in FIG. 2, also showing in phantom lines the configuration of the stock from which the same was molded.

Turning now to FIG. 1, a typical illustrative archery bow 1 is shown which utilizes a bow string 2 and in which a central handgrip 4 separates the limbs 5 which are secured to the limb mount portion 6 of the handgrip 4. Wheels 8 are provided at the extremeties of the bow limb 5 and the bow string 2 is reaved through the wheel 8. A snap on rocker unit 3 is applied to each bow limb 5 as shown also in FIG. 3. The limb 5 is then secured to the handgrip portion 4 by means of the limb adjust bolt 6 with the rocker 3 nesting in a rocker recess inside the handgrip 4.

Figure 2:
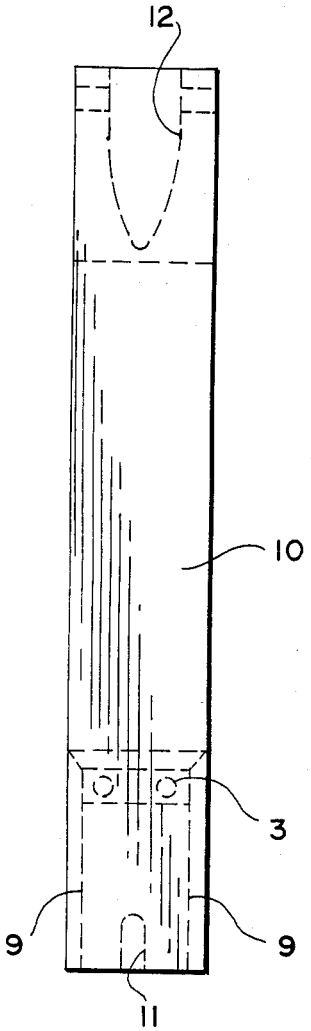
FIG. 2 PRIOR ART
FIG. 2 is a plan view of a prior art type bow limb showing in phantom lines the configuration of the extruded block from which the same is machined.

Turning now to FIG. 2, a typical prior-art bow limb 10 which has been machined as a machined limb 10 is shown. In phantom lines the configuration of the block of fiberglass reinforced material is shown. The prior art machined limb 10 includes a bolt slot 11 for mounting onto the limb bolt 6 of the handgrip 4. At the other end of the prior art machined limb 10, a fork slot 12 is provided which receives an eccentric assembly and its axle 16 for mounting the wheel 8. The front elevation in FIG. 3 along with the plan view of FIG. 2 illustrate the amount of material from the end 9 and dished area 13 which must be machined away in prior art in order to configure the bow limb 10 to its desired shape. It will be appreciated that during this process along the areas where there is a change in thickness or width of the prior art machined limb 10, there will be strands of fiberglass which are cut. This reduces the strength of the reinforcement, leaves exposed ends which could leave splinters, and because the orientation of the fiberglass cannot be positively guaranteed, each limb will differ from the next one to some degree in its strength and bending characteristics due to the varying lengths of the fiberglass strands.

Figure 5:
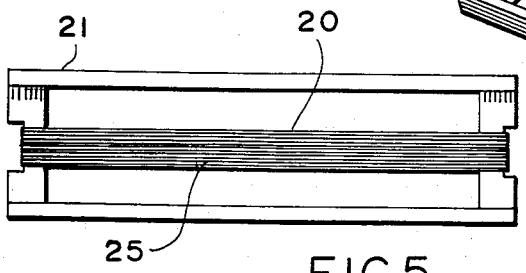
FIG. 5 is a plan view showing the frame before wrapped.
Figure 4:
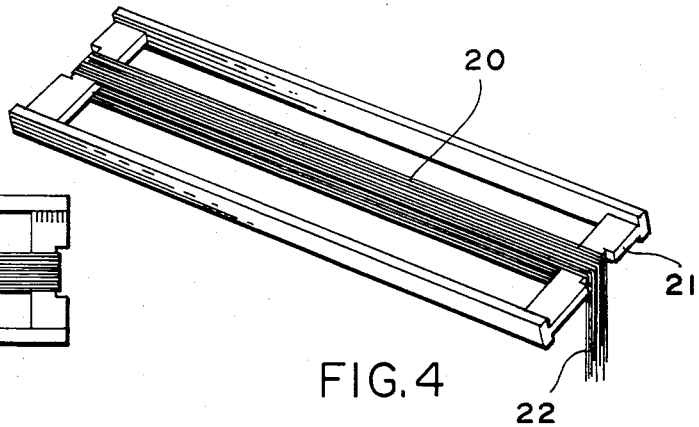
FIG. 4 is a perspective partially diagrammatic view where it will be seen that the fiberglass package is wrapped around a frame after impregnation with a suitable resin.

The bow limb 19 of the present invention (see FIGS. 11, 12) results primarily from its method of formation. This will be shown in simplistic form initially, and then detailed later. The bow limb 19 is formed from a fiberglass package or slug 20 as shown in FIG. 4. This is developed by wrapping fiberglass strands around a frame 21 with six strands of fiberglass 22. A predetermined amount of strands and wraps are employed for a given bow limb. The strands are dipped in a wet out tank prior to being wrapped around the frame 21 as shown in FIG. 4. A "wrap" is a complete closed loop once around the frame. Normally several wraps are employed as shown in FIG. 5 to form a slug 25. Because the strands 20 are already impregnated with a predetermined amount of resin, once the frame is wrapped it is ready to be inserted into the mold assembly 30 as shown in FIGS. 6 and 7. Essentially what happens is that the frame is positioned around the lower female mold 32 of the mold assembly 30. The slug 25 runs the length of the female cavity 36. Thereafter the upper mold 31 which is the male having an upper male member 35 is directed downwardly into the lower cavity 36 or female cavity of the mold. The extent to which the upper mold 35 penetrates the lower mold cavity 36 is a function of the stops 27 which arrest the downward movement of the upper male mold 31. As soon as the molded configuration of the slug 25 is achieved, the strands or slug ends of the wrappings 22 are severed, which leaves a tail or bobtail 40 as shown in FIG. 7. This is cut, as commented, just as soon as the mold assembly 30 has full orientation on the slug 25, and the frame 21 is no longer needed to provide orientation. The mold is normally held closed for about five minutes and at a temperature of about 300° F.

The materials employed are known in the art. The resin is desirably an epoxy. Typically used is an epoxy catalyst purchased from Lindow Chemical, and known as a Lindride 6K catalyst, in combination with a Shell 826 epoxy resin. The catalyst and resin are proportioned in accordance with the manufacturer's directions. The catalyst is essentially heat activated, and accordingly the resin that is employed for soaking the strands 22 may be maintained regularly over a twenty-four hour shift. On the other hand, normally whatever is left at the end of a shift is destroyed and a batch made up fresh with any new shift. The fiberglass which is employed comes in spools, and the satisfactory type used is a Pittsburgh Plate Glass No. 712-218. 712T is the product number and the yield identification is 218. A particular code utilized is 13326-10210. After the slug 25 such as shown in FIG. 8 is removed from the mold, it is stored on a cart which fits within an oven. Once the cart is full, all of the paddles are placed in an oven at 350° F. for about three hours. Prior to placing in the oven and on the cart, the bobtails 40 are cut off, and then the entire paddle is cured in the oven. After the paddle 25 is removed from the oven, it is then severed in the center as shown in FIG. 8 and two limbs, one of which is shown in the righthand side of FIG. 8 results. The particular limb is shown in FIGS. 10 and 11 in respective plan view and front elevation where it will be seen that they have varying cross-sectional dimensions, but a constant cross-sectional area. Subsequently the fork slot 12 is machined out, and the bolt slot 11 machined out. The result is a limb which is quite uniform and consistent. The limbs can be formed to various "limb weights." By "limb weights," we mean a strain guage measurement on a limb which is cantileverly supported at its handle mounting end simulating positioning and pivoting as would occur in a handle. The eccentric axle orientation is the position for the application of force. Each limb is then moved essentially 7½ inches and the deflected weight is measured. Those weights, for purposes of the bow limbs of a short limb and a long limb will vary between 160 pounds and 295 pounds. For the average bow, knowing the length of the limb, and the limb weight, one can generally predict the drawing distance as well as the draw weight of the bow. Each of the limbs is coded after it comes out of the mold so that the anticipated bow limb weight is noted, as well as the model number, length, and thickness. These numbers stay with the limb throughout the entire process.

Figure 12:
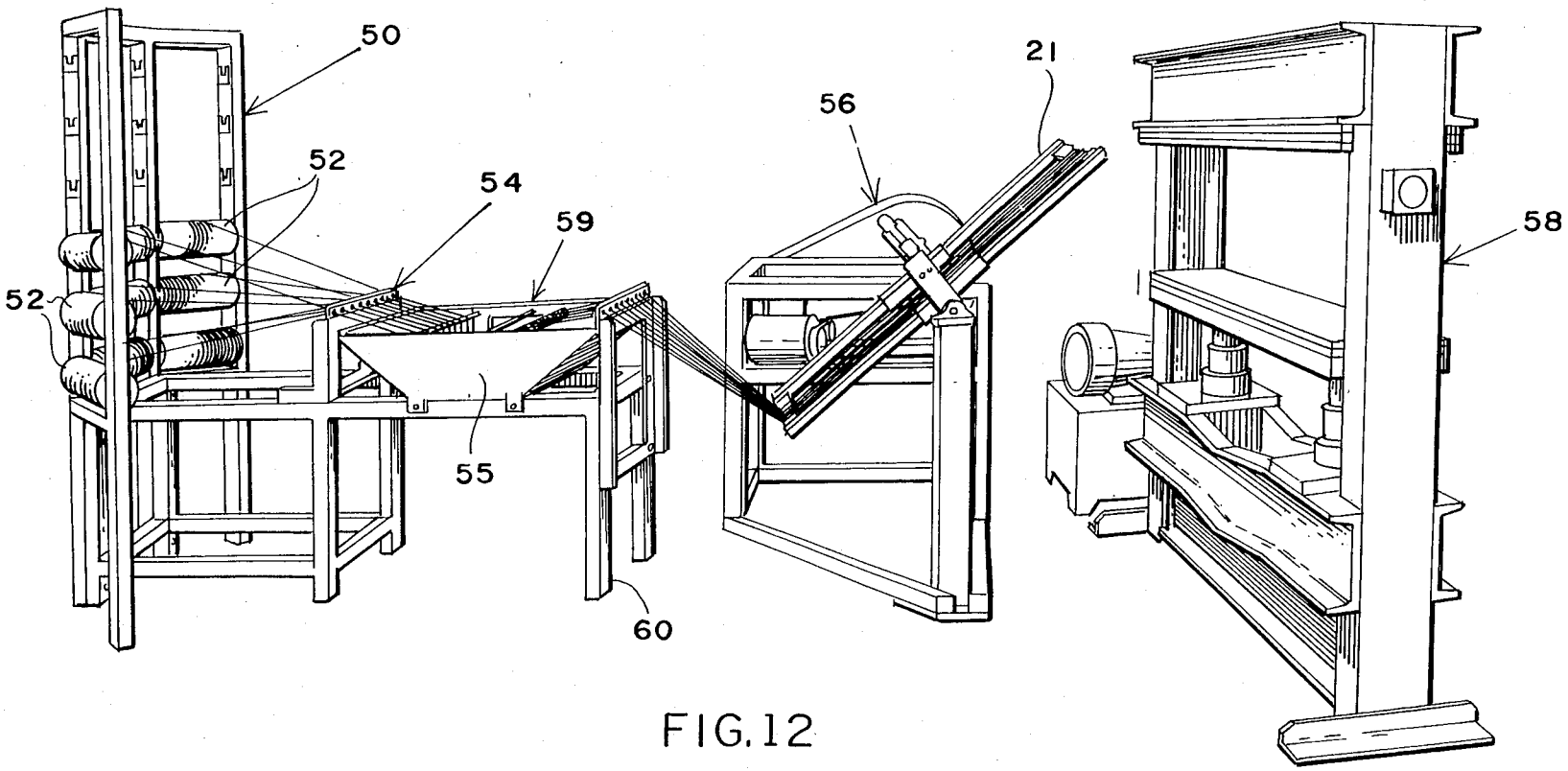
FIG. 12 is a separated isometric view of a production line showing how the limbs are processed.
Figure 13:
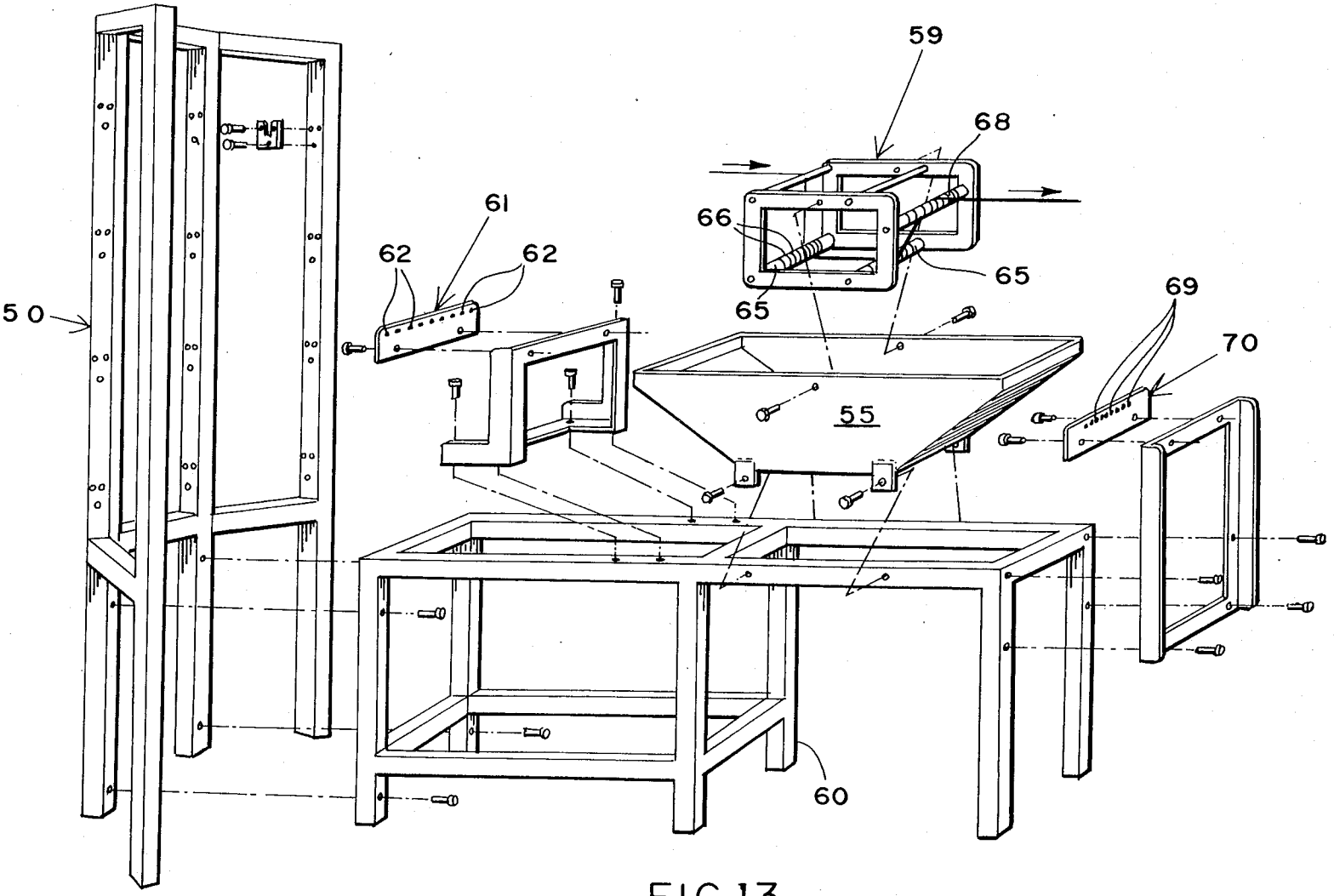
FIG. 13 is an isometric disassembled view of the wet out abrader assembly.

In more detail the process will be understood by reference to FIGS. 12 and 13. As shown in FIG. 11 at the lefthand side there is a spool rack 50 which is proportioned to have a plurality of spaced spool shaft holders 51. These hold the spools 52 of fiberglass strands 22. The strands 22 are then woven through the strand guide 54 and passed down into the wet tank 55 and come out of the wet tank 55 and are ready for wrapping around the frame 21 in the frame wrapper assembly 56 as shown in the mid-portion of FIG. 11. When the right number of closed loop wraps have been made, the frame 21 is then transferred to the mold press 58, to the righthand portion of FIG. 11. The molding and cyclic rates are then essentially as described above relating to FIGS. 4, 6, and 7.

In greater detail, and as shown in FIG. 12, the roving rack assembly 50 is related to the wet out 55 tank and abrader assembly 59 by means of the tank support frame 60. Both the rack 50 and the wet out tank 55 are secured to the frame 60 in spaced relationship. It will be seen there that the strand guide 61 receives the strands in guide holes 62, six in number, and then the same are led to the wet out abrader assembly 59. The wet out abrader assembly 59 (see FIG. 13) has three hold down abraders 65. Each abrader 65 is a longitudinal shaft with grooves 66 to receive the strands. The abrader shafts 65 are typically one inch in diameter, with the undercut reducing the grooves to a half inch diameter. The strands 22 then go underneath the two lower hold down abraders 65, and then come out over the top of the lead out abrader 68. Thereafter the strands pass through the metering holes 69 in the wet out metering plate 70, and pass onto the frame wrapper as previously described. The molding press 58 ideally holds the product at approximately 2200 pounds and at 330° F. with a preheated mold for five to six minutes.

After the molded paddle 18 is formed, as shown in FIG. 8, the two tails 40 are cut along the dotted lines as shown. Each half the paddle 18, as shown in FIG. 9, has a smooth four sided exterior surface, unbroken by machine marks and containing central strands of fiberglass which are also unbroken. The fiberglass strands actually conform to the configuration of the exterior or skin at the outer reaches of the body of the paddle 18, and resin in a small die cavity 42 in the upper die has made an excellent reference mount pad 42 for all subsequent work areas. Similarly the upper mold and the lower mold 31, 32 and more particularly the upper cavity 35 and lower cavity 36 are proportioned to provide a constant cross-section from one end to the other. The same configuration of the fiberglass is as shown in FIG. 9. In FIG. 9 it will also be seen that the axle recess 41 is formed and only the ends need be cut to proper lengths and the bolt slot 11 and eccentric slot 12 need be machined. It is not presently practical to mold the wheel fork in that different models may call for different width forks and as many as three different ones may be required making die costs prohibitive. More precisely, for the normal full length limb a typical paddle formula is 270 (stop space) by 44 (22 full wraps of 12 strands), and this will accommodate a limb weight of 215. For the shorter version limb it is 280 (somewhat thicker) by 40 strands (fewer wraps) for the same weight of 215 pounds. Each adjustment of the die cavity volume can be used effectively with a range of five or six material layers. Too little material will result in the paddle not filling out, and too much material prevents it from closing fully. Use of excessive material can cause inconsistent paddle thicknesses in final weights as well as potential failures from insufficient resin content. With insufficient resin content, there is not enough binder to hold the fiberglass strands together. When abnormal amounts of resin are exhausted out of either end, this also results. Therefore, it is highly desirable to proportion the amount of material as well as the fiberglass wraps for each cavity setting which results in the following:

I. Only five limb weights and therefore only five paddle formulae are currently required for the short limb; they are:

| Stop Thickness | | Individual Wraps | Limb Weight |
|---|---|---|---|
| 260 | X | 36 | 175 |
| 270 | X | 38 | 205 |

-continued

| Stop Thickness | | Individual Wraps | Limb Weight |
|---|---|---|---|
| 280 | X | 40 | 235 |
| 290 | X | 44 | 265 |
| 300 | X | 46 | 295 |

II. Only five limb weights and therefore only five paddle formulae are currently required for the normal long limb line; they are:

| Stop Thickness | | Individual Wraps | Limb Weight |
|---|---|---|---|
| 250 | X | 36 | 160 |
| 260 | X | 42 | 185 |
| 270 | X | 44 | 215 |
| 280 | X | 46 | 235 |
| 290 | X | 48 | 255 |

It will be appreciated from the above that some emperical steps are required in the method, but once the correct number of strands, and the correct amount of resin are determined for a given mold configuration repeatability from slug-to-slug and limb-to-limb is virtually guaranteed. Furthermore, a designer has considerably more flexibility in determining the form and proportion of the molded bow limb 18 since complex machining steps can be avoided. In designing the mold, a predetermined finished long limb or short limb is designed. It must have a constant cross-section to avoid rich areas of plastic and poor areas of plastic (or conversely rich areas of fiberglass and poor areas of fiberglass). This will result in the failures as set forth above. The stops are provided on the mold to provide increasing increments of thickness. In the bow design, the flexing of the limb can be somewhat predetermined by the thinnest point along the length of the limb. If it is to flex uniformly, the thickness is relatively uniform. If it is to flex near the axle or string end, that area progressively thins. On the other hand if it is to flex closer to the handle, that area is thinned.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. A molded bow limb comprising, in combination, a formed body portion, said body portion having varying thicknesses along its length, and varying widths transversely of its length, said width and thickness being proportioned to have a substantially constant cross-section along the entire unslotted length of the limb, said body portion having interior oriented longitudinal strands of fiberglass, said longitudinal strands of fiberglass being characterized in that their orientation is closely conforming to the skin adjacent the skin, and essentially longitudinal in the central portion of the body.

2. The molded bow limb of claim 1 in which, said limb thickness is varied to orient the flexure at the thinner thicknesses.

3. In the molded bow limb of claim 1, an axle slot formed at one end thereof to receive an axle and wheel for a compound bow.

4. In the molded bow limb of claim 1, a mount pad mold on the rear of the limb at its handle end.

* * * * *